US009368061B2

(12) United States Patent
Kim et al.

(10) Patent No.: US 9,368,061 B2
(45) Date of Patent: Jun. 14, 2016

(54) ORGANIC LIGHT EMITTING DIODE DISPLAY DEVICE AND METHOD OF DRIVING THE SAME

(71) Applicant: SAMSUNG DISPLAY CO., LTD., Yongin, Gyeonggi-Do (KR)

(72) Inventors: Tae-Jin Kim, Yongin (KR); An-Su Lee, Yongin (KR); Do-Youb Kim, Yongin (KR); Seung-Woo Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/257,564

(22) Filed: Apr. 21, 2014

(65) Prior Publication Data

US 2015/0022508 A1 Jan. 22, 2015

(30) Foreign Application Priority Data

Jul. 17, 2013 (KR) ..... 10-2013-0084034

(51) Int. Cl.

| | |
|---|---|
| ***G09G 3/30*** | (2006.01) |
| ***G09G 3/32*** | (2016.01) |
| *G09G 3/10* | (2006.01) |

(52) U.S. Cl.

CPC ..... *G09G 3/3225* (2013.01); *G09G 2300/0439* (2013.01); *G09G 2310/06* (2013.01); *G09G 2320/0233* (2013.01); *G09G 2330/08* (2013.01)

(58) Field of Classification Search

CPC . G09G 3/3233; G09G 3/2274; G09G 3/2022; G09G 3/3225

USPC ..... 345/76; 315/169.3

See application file for complete search history.

(56) References Cited

U.S. PATENT DOCUMENTS

| | | | | |
|---|---|---|---|---|
| 7,535,447 | B2 * | 5/2009 | Kwak et al. | 345/87 |
| 7,542,019 | B2 * | 6/2009 | Park et al. | 345/205 |
| 7,545,352 | B2 * | 6/2009 | Kwak | G09G 3/3233 345/82 |
| 7,557,784 | B2 * | 7/2009 | Kwak et al. | 345/205 |
| 7,880,698 | B2 * | 2/2011 | Park et al. | 345/82 |
| 8,289,234 | B2 * | 10/2012 | Kim | 345/76 |
| 8,427,403 | B2 * | 4/2013 | Shin | G09G 3/325 345/79 |
| 2006/0001618 | A1 * | 1/2006 | Shin | G09G 3/325 345/76 |
| 2006/0022909 | A1 * | 2/2006 | Kwak | G09G 3/3233 345/76 |

(Continued)

FOREIGN PATENT DOCUMENTS

| | | |
|---|---|---|
| KR | 10-2006-0002204 | 1/2006 |
| KR | 10-2006-0027593 | 3/2006 |
| KR | 10-2006-0056791 | 5/2006 |

*Primary Examiner* — Adam J Snyder

(74) *Attorney, Agent, or Firm* — Lewis Roca Rothgerber Christie LLP

(57) ABSTRACT

Artifacts in a specific pattern due to a time difference in a VTDC driving scheme may be prevented. A display device includes: a display including a first pixel circuit, a second pixel circuit, and a pixel group having a first light emitting element, a second light emitting element, a third light emitting element and a fourth light emitting element arranged in a first direction; and a light emission driver generating a first sub-light-emission control signal for controlling emission of the first light emitting element and a second sub-light-emission control signal for controlling emission of the second light emitting element in a first subframe, and generating a third sub-light-emission control signal for controlling emission of the third light emitting element and a fourth sub-light-emission control signal for controlling emission of the fourth light emitting element in a second subframe.

17 Claims, 5 Drawing Sheets

(56) References Cited

U.S. PATENT DOCUMENTS

2006/0114193 A1* 6/2006 Kwak et al. ..... 345/76
2006/0124944 A1* 6/2006 Kwak ..... G09G 3/325 257/96
2006/0125807 A1* 6/2006 Park et al. ..... 345/204
2006/0132668 A1* 6/2006 Park et al. ..... 345/204
2006/0139257 A1* 6/2006 Kwak et al. ..... 345/76
2006/0186822 A1* 8/2006 Park ..... 315/169.3
2007/0045620 A1* 3/2007 Park ..... G09G 3/3233 257/40
2007/0103405 A1* 5/2007 Kwak ..... G09G 3/3233 345/76
2008/0036704 A1* 2/2008 Kim et al. ..... 345/76
2011/0279430 A1* 11/2011 Koh ..... 345/76

* cited by examiner

ORGANIC LIGHT EMITTING DIODE DISPLAY DEVICE AND METHOD OF DRIVING THE SAME

CROSS-REFERENCE TO RELATED APPLICATION

This application claims priority to and the benefit of Korean Patent Application No. 10-2013-0084034 filed in the Korean Intellectual Property Office on Jul. 17, 2013, the entire contents of which are incorporated herein by reference.

BACKGROUND (a) Field

The present invention relates to a display device and a method of driving the same.

(b) Discussion of the Related Art

An organic light emitting diode (OLED) display, from among flat panel displays, displays images using OLEDs that generate light through recombination of electrons and holes, and has a high response speed, low power consumption, high light emission efficiency, high luminance, and a wide viewing angle.

A plurality of pixels emitting light in an OLED display includes OLEDs which generate light with predetermined luminance in response to a data current supplied from pixel circuits.

In general, each of RGB pixels in an OLED display panel is driven by a thin film transistor (TFT) circuit to emit light, and each pixel includes a plurality of transistors and capacitors.

A time division controlled (TDC) driving panel can concurrently drive two pixels using a single TFT driving circuit and thus transistor integration of the TDC driving panel is reduced to half the transistor integration of a conventional display panel, thus achieving high resolution.

To drive two pixels using a single driving circuit in the TDC driving panel, a horizontal TDC (HTDC) or vertical TDC (VTDC) driving circuit is shared.

However, in the case of HTDC driving, a conventional TDC driving panel generates color separation in a specific pattern, and in the case of VTDC, the conventional TDC generates artifacts having a specific pattern due to a time difference caused by interlaced operation.

The above information disclosed in this Background section is only for enhancement of understanding of the background of the invention and therefore it may contain information that does not form the prior art that is already known to a person of ordinary skill in the art.

SUMMARY

The present invention has been made in an effort to provide a display device and a method of driving the same by preventing (or reducing) artifacts caused by a time difference in a specific pattern in a VTDC driving mode.

The technical problems solved by embodiments of the present invention are not limited to the above technical problems, and those skilled in the art may understand other technical problems from the following description.

According to an aspect of the present invention, a display device may include: a display having: a first pixel circuit; a second pixel circuit; and a pixel group having a first light emitting element, a second light emitting element, a third light emitting element and a fourth light emitting element arranged along a first direction, the first and third light emitting elements being coupled to the first pixel circuit and the second and fourth light emitting elements being coupled to the second pixel circuit; and a light emission driver configured to generate: a first sub-light-emission control signal for controlling emission of the first light emitting element during a first subframe, a second sub-light-emission control signal for controlling emission of the second light emitting element during the first subframe, a third sub-light-emission control signal for controlling emission of the third light emitting element during a second subframe, and a fourth sub-light-emission control signal for controlling emission of the fourth light emitting element during the second subframe.

A first data signal and a second data signal respectively corresponding to the first light emitting element and the second light emitting element may be respectively delivered to the first pixel circuit and the second pixel circuit during the first subframe, and a third data signal and a fourth data signal respectively corresponding to the third light emitting element and the fourth light emitting element may be respectively delivered to the first pixel circuit and the second pixel circuit during the second subframe.

The first pixel circuit may be coupled to a first scan line and a first initialization line, and the second pixel circuit may be coupled to a second scan line and a second initialization line, wherein a driving current flowing through the first pixel circuit according to the first data signal may be delivered to the first light emitting element according to the first sub-light-emission control signal, during the first subframe, and a driving current flowing through the second pixel circuit according to the second data signal may be delivered to the second light emitting element according to the second sub-light-emission control signal, during the first subframe, and wherein the first pixel circuit may receive the first data signal according to a first scan signal delivered through the first scan line, and the second pixel circuit may receive the second data signal according to a second scan signal delivered through the second scan line, during the first subframe.

The first pixel circuit may be coupled to a first scan line and a first initialization line, and the second pixel circuit may be coupled to a second scan line and a second initialization line, wherein a driving current flowing through the first pixel circuit according to the third data signal may be delivered to the third light emitting element according to the third sub-light-emission control signal, and driving current flowing through the second pixel circuit according to the fourth data signal may be delivered to the fourth light emitting element according to the fourth sub-light-emission control signal, during the second subframe, and wherein the first pixel circuit may receive the third data signal according to a first scan signal delivered through the first scan line, and the second pixel circuit may be receive the fourth data signal according to a second scan signal delivered through the second scan line, during the second subframe.

The first pixel circuit may include: a first transistor configured to be turned on by a first scan signal to apply a corresponding data voltage to a second electrode of a second transistor; the second transistor having a first electrode through which current flows corresponding to a voltage across a control electrode and the second electrode of the second transistor thereof, the second electrode being electrically coupled to a first power source; a fifth transistor configured to be turned on by the first sub-light-emission control signal to deliver a current to the first light emitting element; and a sixth transistor configured to be turned on by the third sub-light-emission control signal to deliver a current to the third light emitting element, and wherein the second pixel circuit includes: a seventh transistor configured to be turned on by a second scan signal to apply a corresponding data voltage to a second electrode of an eighth transistor; the eighth transistor having a first electrode through which current flows corresponding to a voltage across a control electrode and the second electrode of the eighth transistor thereof, the second electrode being electrically coupled to the first power source; an eleventh transistor configured to be turned on by the second sub-light-emission control signal to deliver a current to the second light emitting element; and a twelfth transistor configured to be turned on by the fourth sub-light-emission control signal to deliver a current to the fourth light emitting element, wherein the fifth transistor and the eleventh transistor may be turned on during the first subframe and the sixth transistor and the twelfth transistor may be turned on during the second subframe.

The first pixel circuit may further include a third transistor configured to be turned on in response to the first scan signal to diode-connect the second transistor, and the second pixel circuit may further include a ninth transistor configured to be turned on in response to the second scan signal to diode-connect the eighth transistor.

The first pixel circuit may further include a fourth transistor configured to be turned on by a first initialization signal to apply an initialization voltage to the control electrode of the second transistor, and the second pixel circuit may further include a tenth transistor configured to be turned on by a second initialization signal to apply an initialization voltage to the control electrode of the eighth transistor, wherein the first and third transistors are configured to be turned on by the first scan signal after the fourth transistor is turned on by the first initialization signal, and the seventh and ninth transistors are configured to be turned on by the second scan signal after the tenth transistor is turned on by the second initialization signal.

The first pixel circuit may further include a first capacitor coupled between the first power source and the control electrode of the second transistor, and the second pixel circuit may further include a second capacitor coupled between the first power source and the control electrode of the eighth transistor.

The first pixel circuit may further include a third capacitor coupled between a control electrode of the first transistor and a second electrode of the third transistor, and the second pixel circuit may further include a fourth capacitor coupled between a control electrode of the seventh transistor and a second electrode of the ninth transistor.

According to another aspect of the present invention, a method of driving a display device may include a display having a first pixel circuit, a second pixel circuit, and a pixel group having a first light emitting element, a second light emitting element, a third light emitting element, and a fourth light emitting element arranged along a first direction, the first and third light emitting elements being coupled to the first pixel circuit and the second and fourth light emitting elements being coupled to the second pixel circuit, and a light emission driver configured to generate a first sub-light-emission control signal for controlling emission of the first light emitting element and a second sub-light-emission control signal for controlling emission of the second light emitting element during a first subframe, and generating a third sub-light-emission control signal for controlling emission of the third light emitting element and a fourth sub-light-emission control signal for controlling emission of the fourth light emitting element during a second subframe, the method may include: delivering a first data signal and a second data signal respectively corresponding to the first light emitting element and the second light emitting element to the first pixel circuit and the second pixel circuit, respectively, during the first subframe; and delivering a driving current flowing through the first pixel circuit according to the first data signal to the first light emitting element according to the first sub-light-emission control signal, and delivering a driving current flowing through the second pixel circuit according to the second data signal to the second light emitting element according to the second sub-light-emission control signal during the first subframe.

The method may further include: delivering a driving current flowing through the first pixel circuit according to the third data signal to the third light emitting element according to the third sub-light-emission control signal, and delivering a driving current flowing through the second pixel circuit according to the fourth data signal to the fourth light emitting element according to the fourth sub-light-emission control signal, during the second subframe; and delivering the third data signal to the first pixel circuit according to a first scan signal delivered through the first scan line, and delivering the fourth data signal to the second pixel circuit according to a second scan signal delivered through the second scan line, during the second subframe.

The first pixel circuit may include: a first transistor configured to be turned on by a first scan signal to apply a corresponding data voltage to a second electrode of a second transistor; the second transistor having a first electrode through which current flows corresponding to a voltage across a control electrode and the second electrode of the second transistor thereof, the second electrode being electrically coupled to a first power source; a fifth transistor configured to be turned on by the first sub-light-emission control signal to deliver current to the first light emitting element; and a sixth transistor configured to be turned on by the third sub-light-emission control signal to deliver current to the third light emitting element, and wherein the second pixel circuit includes: a seventh transistor configured to be turned on by a second scan signal to apply a corresponding data voltage to a second electrode of an eighth transistor; the eighth transistor having a first electrode through which current flows corresponding to a voltage across a control electrode and the second electrode of the eighth transistor thereof, the second electrode being electrically coupled to the first power source; an eleventh transistor configured to be turned on by the second sub-light-emission control signal to deliver current to the second light emitting element; and a twelfth transistor configured to be turned on by the fourth sub-light-emission control signal to deliver current to the fourth light emitting element, wherein the method may include: turning on the fifth transistor and the eleventh transistor during the first subframe; and turning on the sixth transistor and the twelfth transistor during the second subframe.

The first pixel circuit may further include a third transistor configured to be turned on in response to the first scan signal to diode-connect the second transistor and a fourth transistor configured to be turned on by a first initialization signal to apply an initialization voltage to the control electrode of the second transistor, wherein the second pixel circuit further includes a ninth transistor configured to be turned on in response to the second scan signal to diode-connect the eighth transistor and a tenth transistor configured to be turned on by a second initialization signal to apply an initialization voltage to the control electrode of the eighth transistor, the method may further include: turning on the first and third transistors by the first scan signal after the fourth transistor is turned on by the first initialization signal; and turning on the seventh and ninth transistors by the second scan signal after the tenth transistor is turned on by the second initialization signal.

The first pixel circuit may further include a first capacitor coupled between the first power source and a control electrode of the second transistor, the method may further include: turning on the fourth transistor by the first initialization signal to apply an initialization voltage to the control electrode of the second transistor and maintaining a first voltage by the first capacitor.

The second pixel circuit may further include a second capacitor coupled between the first power source and a control electrode of the eighth transistor, the method may further include: turning on the tenth transistor by the second initialization signal to apply an initialization voltage to the control electrode of the eighth transistor and maintaining a second voltage by the second capacitor.

The display device and method of driving the same according to the embodiments of the present invention can prevent artifacts in a specific pattern due to a time difference in the VTDC driving scheme.

DETAILED DESCRIPTION

Figure 1:
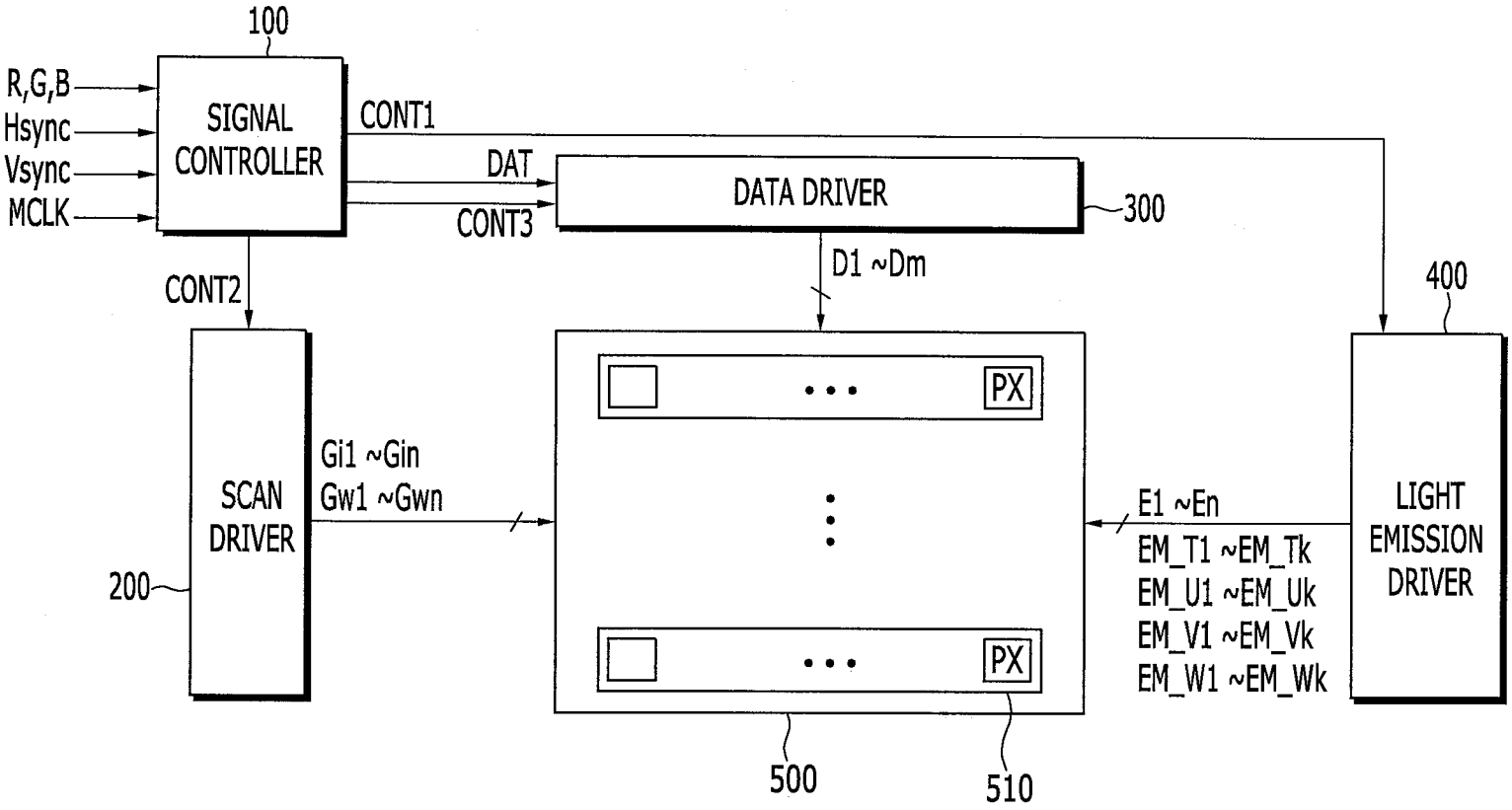
FIG. 1 is a diagram showing a display device according to an example embodiment of the present invention.

The embodiments of the present invention will be described more fully hereinafter with reference to the accompanying drawings, in which example embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

In addition, unless explicitly described to the contrary, the word "comprise" and variations such as "comprises" or "comprising" will be understood to imply the inclusion of stated elements but not the exclusion of any other elements. The terms "-er(or)", "module", "portion", or "part" is used to signify a unit performing at least one function or operation. The unit can be realized in hardware, software, or in combination of both. Expressions such as "at least one of," when preceding a list of elements, modify the entire list of elements and do not modify the individual elements of the list. Further, the use of "may" when describing embodiments of the present invention refers to "one or more embodiments of the present invention."

FIG. 1 is a diagram showing a display device according to an example embodiment of the present invention.

Referring to FIG. 1, the display device according to the example embodiment of the present invention includes a signal controller 100, a scan driver 200, a data driver 300, a light emission driver 400, and a display 500.

The signal controller 100 receives external video signals RGB and input control signals for controlling display of the video signals. The video signals RGB include luminance information of each pixel included in each pixel group PX. The luminance information includes data indicating the gray-level of the corresponding pixel from among a predetermined number of graylevels (for example, $1024=2^{10}$, $256=2^{8}$, or $64=2^{6}$ graylevels). The input control signals include a vertical synchronization signal Vsync, a horizontal synchronization signal Hsync, and a main clock signal MCLK.

The signal controller 100 processes the video signals RGB into signals adapted to operate the display 500 and the data driver 300 based on the video signal RGB and the input control signals, and generates emission control signals CONT1, a scan control signal CONT2, a data control signal CONT3, and a video data signal DAT.

The signal controller 100 divides each frame of the video signals RGB into first and second subframes, and determines a driving method of a plurality of pixel groups PX.

The signal controller 100 generates a plurality of emission control signals CONT1 for respectively controlling emission periods and non-emission periods of the plurality of pixel groups PX, and provides the emission control signals CONT1 to the light emission driver 400.

The signal controller 100 divides the video signals RGB into frames according to the vertical synchronization signal Vsync, and segments each frame into first and second subframes. Video signals RGB to be written to the pixel groups in each subframe are divided for a plurality of scan lines Gi1 to Gin and Gw1 to Gwn according to the horizontal synchronization signal Hsync. The signal controller 100 converts the video signals RGB into image data signals DAT by processing the video signals RGB (for example, by performing gamma correction on the video signals RGB).

The signal controller 100 transfers the scan control signal CONT2 to the scan driver 200, and delivers the data control signal CONT3 and image data signals DAT to the data driver 300.

The scan driver 200 delivers a plurality of scan signals to a plurality of scan lines Gi1 to Gin and Gw1 to Gwn, respectively, formed corresponding to a plurality of pixel groups PX according to the scan control signal CONT2.

The data driver 300 delivers a plurality of data signals corresponding to the image data signals DAT to a plurality of data lines D1 to Dm, respectively, according to the data control signal CONT3.

According to an embodiment, the data driver 300 delivers, through the plurality of data lines D1 to Dm, a plurality of data signals for controlling degrees of light emission of pixels of the plurality of pixel groups PX, in synchronization with a time when a scan signal of a gate-on voltage corresponding to each subframe is supplied. The gate-on voltage corresponds to a level that turns on switching transistors Ms1 and Ms2 (see, for example, FIG. 3).

The light emission driver 400 delivers a plurality of light emission signals to a plurality of main light emission control lines E1 to En, respectively, and first to fourth sub-light-emission control lines EM_T1-EM_Tk, EM_U1-EM_Uk, EM_V1-EM_Vk, and EM_W1-EM_Wk, respectively, according to the light emission control signals CONT1.

The display 500 includes a plurality of data lines D1 to Dm extending in a column direction, a plurality of scan lines Gi1 to Gin and Gw1 to Gwn extending in a row direction, main light emission control lines E1 to En, first sub-light-emission control lines EM_T1 to EM_Tk, second sub-light-emission control lines EM_U1 to EM_Uk, third sub-light-emission control lines EM_V1 to EM_Vk, fourth sub-light-emission control lines EM_W1 to EM_Wk, and a plurality of pixel groups PX.

The plurality of pixel groups are respectively coupled to the plurality of data lines D1 to Dm, the plurality of scan lines Gi1 to Gin and Gw1 to Gwn, the plurality of main light emission control lines E1 to En, the first sub-light-emission control lines EM_T1 to EM_Tk, the second sub-light-emission control lines EM_U1 to EM_Uk, the third sub-light-emission control lines EM_V1 to EM_Vk and the fourth sub-light-emission control lines EM_W1 to EM_Wk.

Data voltages corresponding to the image data signals DAT are delivered to corresponding pixel groups PX through the plurality of data lines D1 to Dm, and a plurality of scan signals for selecting a plurality of pixel circuits (e.g., PX1 and PX2 shown in FIG. 2) of the pixel group PX coupled to each scan line is delivered through the plurality of scan lines Gi1 to Gin and Gw1 to Gwn.

A plurality of light emitting signals for controlling light emission of a plurality of light emitting elements OLED11 to OLED 22 of the plurality of pixel groups PX is delivered to the plurality of pixel groups PX corresponding thereto through the plurality of main light emission control lines E1 to En and the first to fourth sub-light-emission control lines EM_T1 to EM_Tk, EM_U1 to EM_Uk, EM_V1 to EM_Vk and EM_W1, to EM_Wk.

Detailed configuration of the pixel groups PX will now be described with reference to FIGS. 2 and 3.

Figure 2:
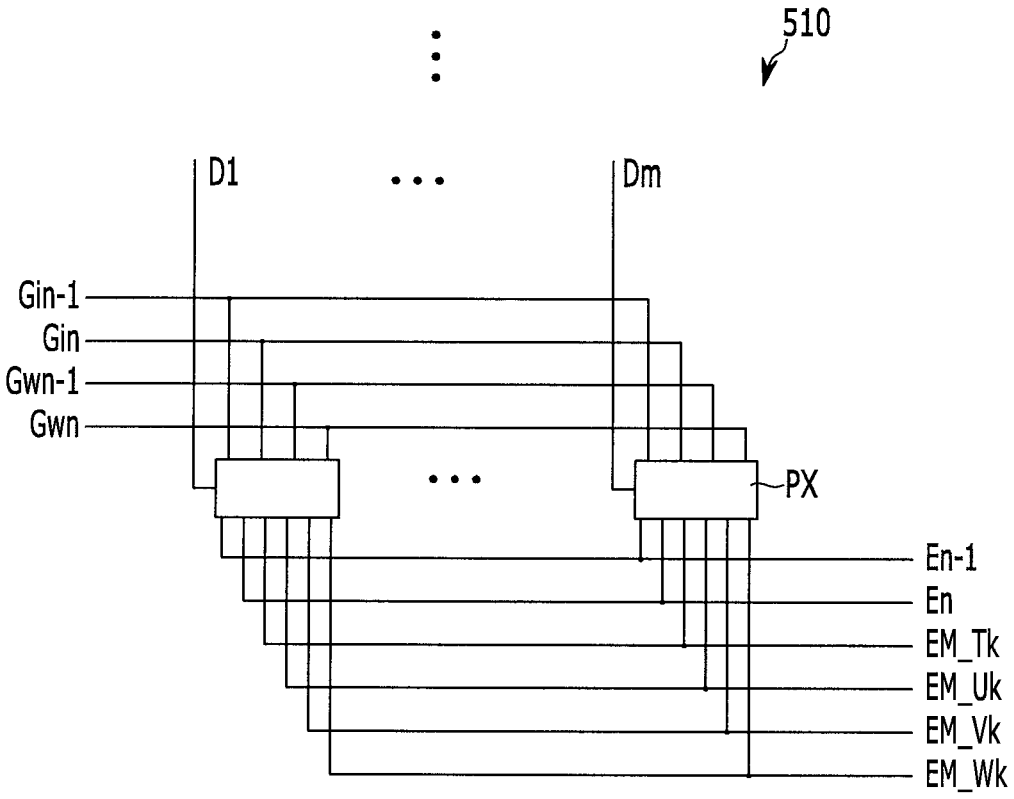
FIG. 2 is a diagram showing an n-th row of a display device according to an example embodiment of the present invention.

FIG. 2 is a diagram showing an n-th row of the display device according to the example embodiment of the present invention.

Figure 3:
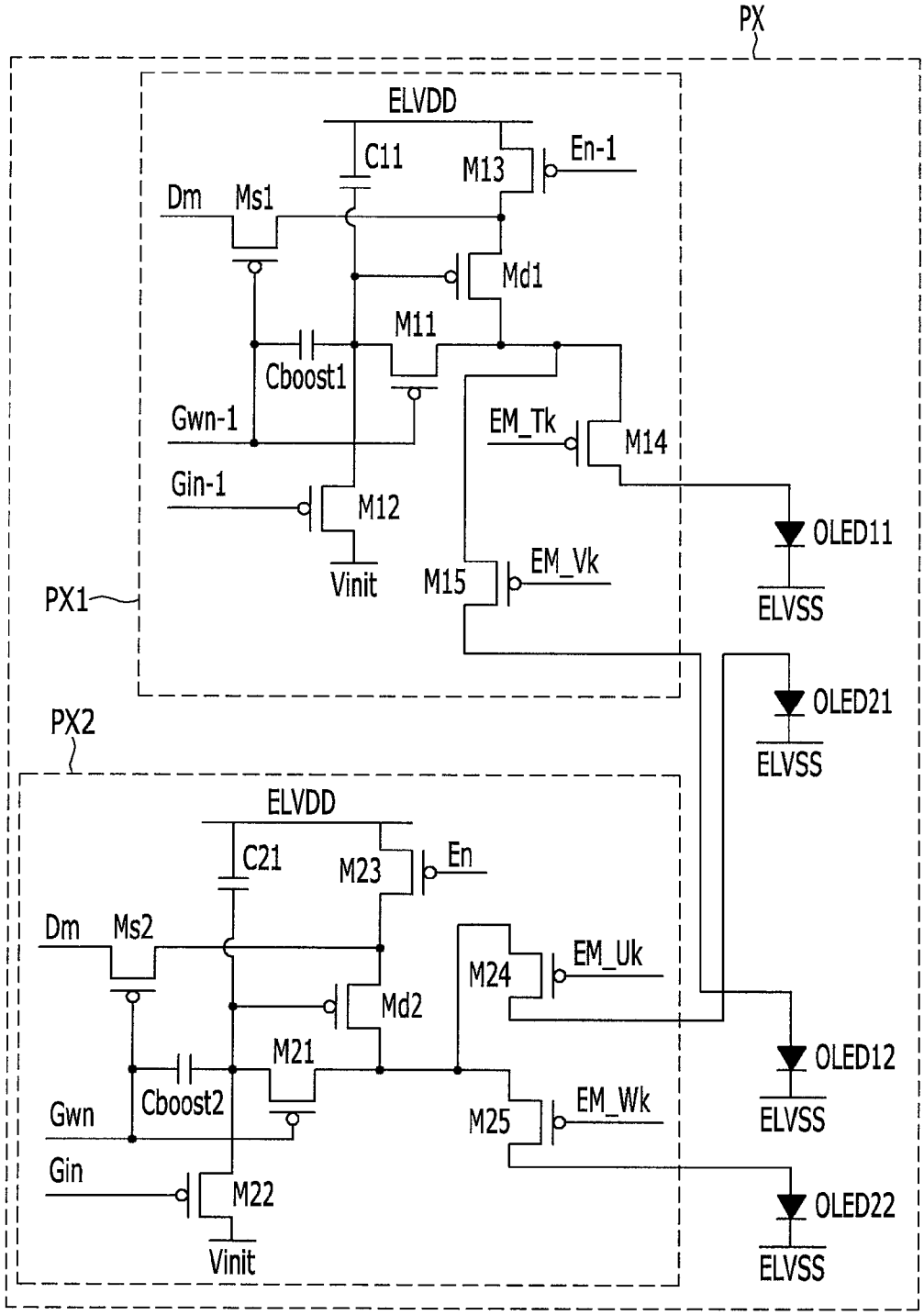
FIG. 3 is a diagram showing a circuit of a pixel group according to an embodiment of the present invention.

FIG. 3 is a diagram showing a circuit of a pixel group according to an embodiment of the present invention.

Referring to FIG. 2, each pixel group PX corresponding to an n-th row 510 including a plurality of pixel groups PX is coupled to n-th scan lines Gin and Gwn, an n-th main light emission control line En, n-th first sub-light-emission control line EM_Tk, an n-th second sub-light-emission control line EM_Uk, an n-th third sub-light-emission control line EM_Vk, an n-th fourth sub-light-emission control line EM_Wk, and an m-th data line Dm.

Referring to FIG. 3, the first sub-light-emission control line EM_Tk controls light emission of a first light emitting element OLED11, which emits light according to an image data signal DAT written in (or during) the first subframe, out of the two light emitting elements OLED11 and OLED12 coupled to a first pixel circuit PX1.

The second sub-light-emission control line EM_Uk controls light emission of a third light emitting element OLED21, which emits light according to the image data signal DAT written in the first subframe, out of the two light emitting elements OLED21 and OLED22 coupled to a second pixel circuit PX2 included in the pixel group PX.

The third sub-light-emission control line EM_Vk controls light emission of a second light emitting element OLED12, which emits light according to an image data signal DAT written in the second subframe, out of the two light emitting elements OLED11 and OLED12 coupled to the first pixel circuit PX1 included in the pixel group PX.

The fourth sub-light-emission control line EM_Wk controls light emission of a fourth light emitting element OLED22, which emits light according to the image data signal DAT written in (or during) the second subframe, out of the two light emitting elements OLED21 and OLED22 coupled to a second pixel circuit PX2 included in the pixel group PX.

Referring to FIG. 3, the pixel group PX includes the first pixel circuit PX1, the second pixel circuit PX2, and the first, second, third, and fourth light emitting elements OLED11, OLED12, OLED21, and OLED22.

The first light emitting element OLED11 and the third light emitting element OLED12 share the first pixel circuit PX1, and the second light emitting element OLED21 and the fourth light emitting element OLED22 share the second pixel circuit PX2.

The first, second, third, and fourth light emitting elements are arranged in the order of the first light emitting element OLED11, the second light emitting element OLED21, the third light emitting element OLED12, and the fourth light emitting element OLED22 in the column direction, from top to bottom.

Each light emitting element included in the pixel group PX may emit light having one of red R, green G, and blue B colors.

Driving voltages ELVDD and ELVSS for operating the pixel group PX are supplied to respective terminals of the pixel group PX between which each of the light emitting elements OLED11, OLED12, OLED21, and OLED22 is serially coupled with one of the driving transistors Md1 and Md2.

Referring to FIG. 3, the first pixel circuit PX1 includes the switching transistor Ms1, the driving transistor Md1, a plurality of transistors M11 to M15, capacitors C11 and Cboost1, the first light emitting element OLED11, and the third light emitting element OLED12.

According to an embodiment of the present invention, the switching transistor Ms1 includes a gate electrode coupled to the scan line Gwn-1, a source electrode coupled to the data line Dm, and a drain electrode coupled to the driving transistor Md1. The switching transistor Ms1 is turned on by a scan signal applied to the scan line Gwn-1 to deliver a data voltage applied to the data line Dm to the source electrode of the driving transistor Md1.

The driving transistor Md1 includes a source electrode to which the data voltage is applied when the switching transistor Ms1 is turned on, a gate electrode coupled to the first terminal of the capacitor C11, and a drain electrode coupled to the source electrode of the transistor M14. The second terminal of the capacitor C11 is coupled to a voltage source generating the driving voltage ELVDD.

The transistor M11 includes a gate electrode coupled to the scan line Gwn-1, a source electrode coupled to the gate electrode of the driving transistor Md1, and a drain electrode coupled to the drain electrode of the driving transistor Md1. The transistor M11 is turned on by the scan signal applied to the scan line Gwn-1 to diode-connect the driving transistor Md1.

The first terminal of the capacitor Cboost1 is coupled to the scan line Gwn-1 and the second terminal thereof is coupled to the source electrode of the transistor M11.

The transistor M12 includes a gate electrode coupled to the scan line Gin-1, a source electrode coupled to a voltage source generating an initialization voltage Vint, and a drain electrode coupled to the gate electrode of the driving transistor Md1.

The transistor M13 includes a gate electrode coupled to the main light emission control line En-1, a source electrode coupled to the voltage source generating the driving voltage ELVDD, and a drain electrode coupled to the source electrode of the driving transistor Md1.

The transistor M14 includes a gate electrode coupled to the first sub-light-emission control line EM_Tk, a source electrode coupled to the drain electrode of the driving transistor Md1, and a drain electrode coupled to the anode of the first light emitting element OLED11.

The cathode of the first light emitting element OLED11 is coupled to the voltage source generating the driving voltage ELVSS. The first light emitting element OLED11 emits light according to a current flowing through the driving transistor Md1 when the transistor M14 is turned on by a light emitting signal delivered through the first sub-light-emission control line EM_Tk.

The transistor M15 includes a gate electrode coupled to the third sub-light-emission control line EM_Vk, a source electrode coupled to the drain electrode of the driving transistor Md1, and a drain electrode coupled to the anode of the third light emitting element OLED12.

The cathode of the third light emitting element OLED12 is coupled to the voltage source generating the driving voltage ELVSS. The third light emitting element OLED12 emits light according to current flowing through the driving transistor Md1 when the transistor M15 is turned on by a light emitting signal delivered through the third sub-light-emission control line EM_Vk.

The transistor M12 is turned on by an initialization signal having an enable level (i.e., enable signal), transmitted through the scan line Gin-1, and thus the initialization voltage Vint is applied to the gate electrode of the driving transistor Md1 and the capacitor C11 maintains a voltage ELVDD-VINT (i.e., a voltage difference of ELVDD and VINT). Subsequently, the switching transistor Ms1 and the transistor M11 are turned on by the enable signal transmitted through the scan line Gwn-1.

When the transistor M11 is turned on, the driving transistor Md1 enters a diode-connected state. Accordingly, the gate-source voltage of the driving transistor Md1 corresponds to the threshold voltage of the driving transistor Md1.

When the switching transistor Ms1 is turned on, the data voltage from the data line Dm is applied to the source electrode of the driving transistor Md1. If the data voltage from the data line Dm is Vdata and the threshold voltage of the driving transistor Md1 is Vth (e.g., a negative voltage), the gate voltage of the driving transistor Md1 corresponds to Vdata+Vth.

Subsequently, the transistor M13 is turned on by the enable signal transmitted through the main light emission control line En-1.

The transistor M14 is turned on by the enable signal transmitted through the first sub-light-emission control line EM_Tk, enabling the first light emitting element OLED11 to emit light.

The transistor M15 is turned on by the enable signal transmitted through the third sub-light-emission control line EM_Vk, enabling the third light emitting element OLED12 to emit light.

Here, the gate-source voltage of the driving transistor Md1 is represented by Equation 1.

$$Vgs=(V\text{data}+Vth)-ELVDD \quad \text{[Equation 1]}$$

Here, Vgs denotes the gate-source voltage of the driving transistor Md1, Vth denotes the threshold voltage of the driving transistor Md1, and Vdata denotes the data voltage transmitted through the data line Dm. Current flows through the first light emitting element OLED11 through the driving transistor Md1 to emit light.

Current flowing through the first light emitting element OLED11 and the third light emitting element OLED12 is represented by Equation 2.

$$IOLED=\beta/2(Vgs-Vth)^2=\beta/2((V\text{data}+Vth-ELVDD)-Vth)^2=\beta/2((V\text{data}-ELVDD)^2 \quad \text{[Equation 2]}$$

Here, IOLED denotes current flowing through the first light emitting element OLED11 and the third light emitting element OLED12, and β denotes a constant.

The second pixel circuit PX2 includes the switching transistor Ms2, the driving transistor Md2, a plurality of transistors M21 to M25, capacitors C21 and Cboost2, the second light emitting element OLED21, and the fourth light emitting element OLED22.

According to an embodiment of the present invention, the switching transistor Ms2 includes a gate electrode coupled to the scan line Gwn, a source electrode coupled to the data line Dm, and a drain electrode coupled to the source electrode of the driving transistor Md2. The switching transistor Ms2 is turned on by a scan signal applied to the scan line Gwn to deliver a data voltage applied to the data line Dm to the source electrode of the driving transistor Md2.

The driving transistor Md2 includes a source electrode to which the data voltage is applied when the switching transistor Ms2 is turned on, a gate electrode coupled to the first terminal of the capacitor C21, and a drain electrode coupled to the source electrode of the transistor M24. The second terminal of the capacitor C21 is coupled to the voltage source generating the driving voltage ELVDD.

The transistor M21 includes a gate electrode coupled to the scan line Gwn, a source electrode coupled to the gate electrode of the driving transistor Md2, and a drain electrode coupled to the drain electrode of the driving transistor Md2. The transistor M21 is turned on by the scan signal applied to the scan line Gwn to diode-connect the driving transistor Md2.

The first terminal of the capacitor Cboost2 is coupled to the scan line Gwn and the second terminal thereof is coupled to the source electrode of the transistor M21.

The transistor M22 includes a gate electrode coupled to the scan line Gin, a source electrode coupled to the voltage source generating the initialization voltage Vint, and a drain electrode coupled to the gate electrode of the driving transistor Md2.

The transistor M23 includes a gate electrode coupled to the main light emission control line En, a source electrode coupled to the voltage source generating the driving voltage ELVDD, and a drain electrode coupled to the source electrode of the driving transistor Md2.

The transistor M24 includes a gate electrode coupled to the second sub-light-emission control line EM_Uk, a source electrode coupled to the drain electrode of the driving transistor Md2, and a drain electrode coupled to the anode of the second light emitting element OLED21.

The cathode of the second light emitting element OLED21 is coupled to the voltage source generating the driving voltage ELVSS. The second light emitting element OLED21 emits light according to current flowing through the driving transistor Md2 when the transistor M24 is turned on by a light emitting signal delivered through the second sub-light-emission control line EM_Uk.

The transistor M25 includes a gate electrode coupled to the fourth sub-light-emission control line EM_Wk, a source electrode coupled to the drain electrode of the driving transistor Md2, and a drain electrode coupled to the anode of the fourth light emitting element OLED22.

The cathode of the fourth light emitting element OLED22 is coupled to the voltage source generating the driving voltage ELVSS. The fourth light emitting element OLED22 emits light according to current flowing through the driving transistor Md2 when the transistor M25 is turned on by a light emitting signal delivered through the fourth sub-light-emission control line EM_Wk.

The transistor M22 is turned on by the enable signal transmitted through the scan line Gin, and thus the initialization voltage Vint is applied to the gate electrode of the driving transistor Md2 and the capacitor C21 maintains a voltage ELVDD-VINT. Subsequently, the switching transistor Ms2 and the transistor M21 are turned on by the enable signal transmitted through the scan line Gwn.

When the transistor M21 is turned on, the driving transistor Md2 enters a diode-connected state. Accordingly, the gate-source voltage of the driving transistor Md2 corresponds to the threshold voltage of the driving transistor Md2.

When the switching transistor Ms2 is turned on, the data voltage from the data line Dm is applied to the source electrode of the driving transistor Md2. If the data voltage from the data line Dm is Vdata and the threshold voltage of the driving transistor Md2 is Vth (e.g., a negative voltage), the gate voltage of the driving transistor Md2 corresponds to Vdata+Vth.

Subsequently, the transistor M23 is turned on by the enable signal transmitted through the main light emission control line En.

The transistor M24 is turned on by the enable signal transmitted through the second sub-light-emission control line EM_Uk, thus enabling the second light emitting element OLED21 to emit light.

The transistor M25 is turned on by the enable signal transmitted through the fourth sub-light-emission control line EM_Wk, thus enabling the fourth light emitting element OLED22 to emit light.

Here, the gate-source voltage of the driving transistor Md2 is represented by Equation 1, and current flowing through the second light emitting element OLED21 and the fourth light emitting element OLED22 is represented by Equation 2.

While FIG. 3 shows the transistors Ms1, Ms2, Md1, Md2, M11 to M15, and M21 to M25 as p-channel MOS transistors, any suitable transistors having functions similar to those of the p-channel MOS transistors may replace the p-channel MOS transistors.

Figure 4A:
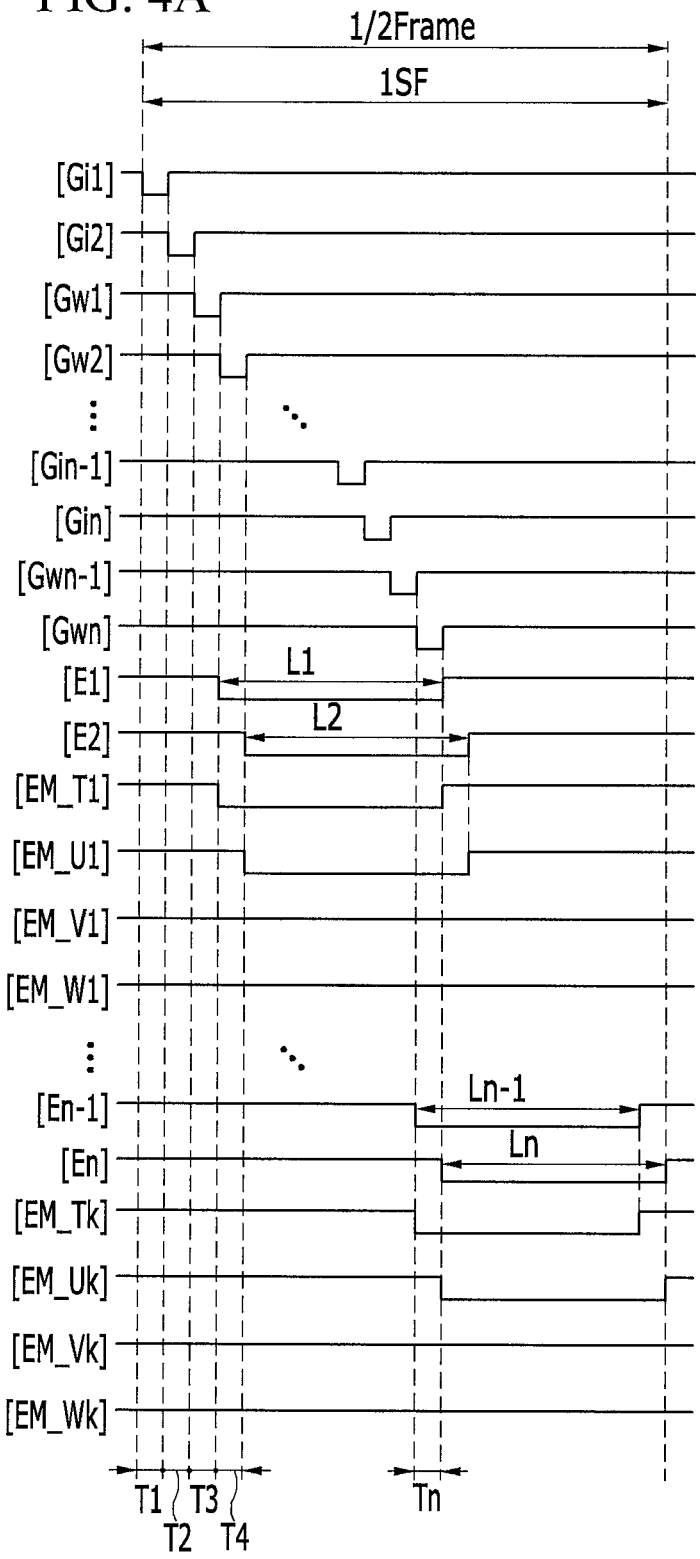
FIG. 4A is a timing diagram showing a driving time of a first subframe for explaining operation of the pixel group shown in FIG. 3.
Figure 4B:
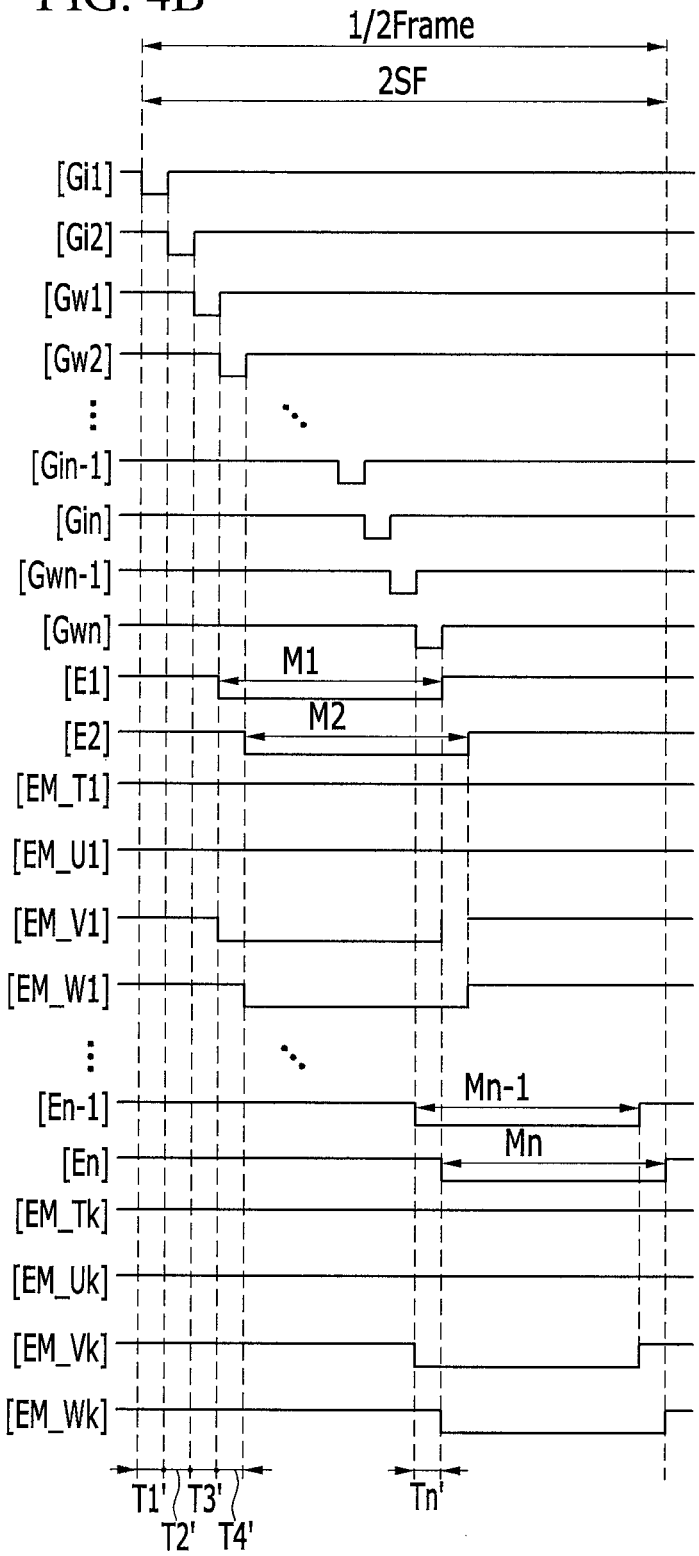
FIG. 4B is a timing diagram showing a driving time of a second subframe for explanation of operation of the pixel group shown in FIG. 3.

FIG. 4A is a timing diagram showing driving times of the first subframe for explaining operation of the pixel group shown in FIG. 3, and FIG. 4B is a timing diagram showing driving times of the second subframe.

FIG. 4A shows the driving times for the first subframe only and FIG. 4B shows the driving times for the second subframe only, for better understanding and ease of description. According to an embodiment of the present invention, a plurality of pixel groups may have the same pixel structure, and the pixel group PX shown in FIG. 3 may be applied to other OLED display devices. The reference numerals of the transistors shown in FIG. 3 are applied to transistors in other pixel groups for better understanding and ease of description.

Referring to FIGS. 4A and 4B, according to an embodiment of the present invention, a frame includes the first subframe 1SF and the second subframe 2SF. The first subframe 1SF includes a plurality of scan periods T1 to Tn and a plurality of light emitting periods L1 to Ln, whereas the second subframe 2SF includes a plurality of scan periods T1' to Tn' and a plurality of light emitting periods M1 to Mn.

The enable signal is applied to the scan line Gi1 at the start point of the scan period T1 of the first subframe 1SF. Then, the transistor M12 is turned on and thus the initialization voltage Vint is applied to the gate electrode of the driving transistor Md1, and the capacitor C11 maintains the voltage ELVDD-Vint.

The enable signal is applied to the scan line Gi2 at the start point of the scan period T2. Then, the transistor M22 is turned on and thus the initialization voltage Vint is applied to the gate electrode of the driving transistor Md2, and the capacitor C21 maintains the voltage ELVDD-Vint.

Subsequently, the enable signal is applied to the scan line Gw1 at the start point of the scan period T3. Then, the switching transistor Ms1 and the transistor M11 are turned on.

When the transistor M11 is turned on, the driving transistor Md1 enters a diode-connected state. Accordingly, the gate-source voltage of the driving transistor Md1 corresponds to the threshold voltage of the driving transistor Md1.

When the switching transistor Ms1 is turned on, a data voltage from the data line D1 is applied to the source electrode of the driving transistor Md1.

The enable signal is applied to the main light emission control line E1 and the first sub-light-emission control line EM_T1 at the start point of the light emitting period L1. The transistor M13 is turned on by the enable signal applied through the light emission control line E1, and the transistor M14 is turned on by the enable signal applied through the first sub-light-emission control line EM_T1. Accordingly, the first light emitting element OLED11 emits light according to current flowing through the driving transistor Md1 during the light emitting period L1.

Subsequently, the enable signal is applied to the scan line Gw2 at the start point of the scan period T4. Then, the switching transistor Ms2 and the transistor M21 are turned on.

When the transistor M21 is turned on, the driving transistor Md2 enters a diode-connected state. Accordingly, the gate-source voltage of the driving transistor Md2 corresponds to the threshold voltage of the driving transistor Md2.

When the switching transistor Ms2 is turned on, the data voltage from the data line D1 is applied to the source electrode of the driving transistor Md2.

The enable signal is applied to the main light emission control line E2 and the second sub-light-emission control line EM_U1 during the light emitting period L2. Then, the transistor M23 is turned on by the enable signal applied through the main light emission control line E2, and the transistor M24 is turned on by the enable signal applied through the second sub-light emission control line EM_U1. Accordingly, the second light emitting element OLED21 emits light according to current flowing through the driving transistor Md2 during the light emitting period L1.

A disable signal is applied to the second sub-light-emission control line EM_V1 and the fourth sub-light-emission control line EM_W1 in the first subframe 1SF, and thus the transistor M15 and the transistor M25 are turned off in the first subframe 1SF.

In this way, data signals corresponding to image data signals DAT are sequentially written to corresponding pixel groups PX through corresponding data lines from among the plurality of data lines D1 to Dm in the plurality of scan periods T1 to Tn. Light emitting elements corresponding to the data signals written during the plurality of light emitting periods L1 to Ln sequentially emit light.

While FIG. 4A shows, according to an embodiments, that the enable signal is applied to the main light emission control line E1 during the light emitting period L1 and the enable signal is applied to the main light emission control line E2 during the light emitting period L2, the present invention is not limited thereto, and the enable signal can be applied in the first subframe 1SF.

Referring to FIG. 4B, the enable signal is applied to the scan line Gi1 at the start point of the scan period T1' of the second subframe 2SF. Then, the transistor M12 is turned on and thus the initialization voltage Vint is applied to the gate electrode of the driving transistor Md1 and the capacitor C11 maintains the voltage ELVDD-Vint.

The enable signal is applied to the scan line Gi2 at the start point of the scan period T2'. Then, the transistor M22 is turned on and thus the initialization voltage Vint is applied to the gate electrode of the driving transistor Md2 and the capacitor C21 maintains the voltage ELVDD-Vint.

Subsequently, the enable signal is applied to the scan line Gw1 at the start point of the scan period T3'. Then, the switching transistor Ms1 and the transistor M11 are turned on.

When the transistor M11 is turned on, the driving transistor Md1 enters a diode-connected state. Accordingly, the gate-source voltage of the driving transistor Md1 corresponds to the threshold voltage of the driving transistor Md1.

When the switching transistor Ms1 is turned on, a data voltage from the data line D1 is applied to the source electrode of the driving transistor Md1.

The enable signal is applied to the main light emission control line E1 and the third sub-light-emission control line EM_V1 at the start point of the light emitting period M1. Then, the transistor M13 is turned on by the enable signal applied through the light emission control line E1, and the transistor M15 is turned on by the enable signal applied through the third sub-light-emission control line EM_V1. Accordingly, the third light emitting element OLED12 emits light according to a current flowing through the driving transistor Md1 during the light emitting period M1.

Subsequently, the enable signal is applied to the scan line Gw2 at the start point of the scan period T4'. Then, the switching transistor Ms2 and the transistor M21 are turned on. When the transistor M21 is turned on, the driving transistor Md2 enters a diode-connected state. Accordingly, the gate-source voltage of the driving transistor Md2 corresponds to the threshold voltage of the driving transistor Md2. When the switching transistor Ms2 is turned on, the data voltage from the data line Dm is applied to the source electrode of the driving transistor Md2.

The enable signal is applied to the main light emission control line E2 and the fourth sub-light-emission control line EM_W1 during the light emitting period M2. Then, the transistor M23 is turned on by the enable signal applied through the main light emission control line E2, and the transistor M25 is turned on by the enable signal applied through the fourth sub-light emission control line EM_W1. Accordingly, the fourth light emitting element OLED22 emits light according to current flowing through the driving transistor Md2 during the light emitting period M2.

A disable signal is applied to the first sub-light-emission control line EM_T1 and the third sub-light-emission control line EM_U1 in the second subframe 2SF, and thus the transistor M14 and the transistor M24 are turned off in the second subframe 2SF.

In this way, data signals corresponding to image data signals DAT are sequentially written to corresponding pixel groups PX through corresponding data lines from among the plurality of data lines D1 to Dm in the plurality of scan periods T1' to Tn'. Light emitting elements corresponding to the data signals written during the plurality of light emitting periods M1 to Mn sequentially emit light.

While FIG. 4B shows that the enable signal is applied to the main light emission control line E1 during the light emitting period M1 and the enable signal is applied to the main light emission control line E2 during the light emitting period M2, the present invention is not limited thereto, and the enable signal can be applied in the second subframe 1SF.

TFTs of pixels have different threshold voltages Vth due to non-uniform manufacturing processes and thus different quantities (or amounts) of current are supplied to OLEDs. Accordingly, the OLEDs have different luminances. However, according to the embodiments of the present invention, a uniform quantity of current can be supplied to the first to fourth OLEDs even when the driving transistors Md1 and Md2 of each pixel group PX have different threshold voltages, as represented by Equation 2, because the influence of the threshold voltage difference can be reduced or eliminated. Accordingly, it is possible to control luminance non-uniformity according to positions of the pixels PX.

While this invention has been described in connection with what is presently considered to be practical example embodiments, it is to be understood that the invention is not limited to the disclosed embodiments, but, to the contrary, is intended to cover various modifications and equivalent arrangements included within the spirit and scope of the appended claims.

| Description of Symbols | |
|---|---|
| 100: signal controller | 200: scan driver |
| 300: data driver | 400: light emission driver |
| 500: display | PX: pixel group |
| PX1: first pixel circuit | PX2: second pixel circuit |

What is claimed is:

1. A display device comprising:

a display comprising:

a first pixel circuit;

a second pixel circuit; and a pixel group comprising a first light emitting element, a second light emitting element, a third light emitting element and a fourth light emitting element sequentially arranged along a first direction, the first and third light emitting elements being coupled to the first pixel circuit, and the second and fourth light emitting elements being coupled to the second pixel circuit; and a light emission driver configured to generate:

a first sub-light-emission control signal for controlling emission of the first light emitting element during a first subframe, a second sub-light-emission control signal for controlling emission of the second light emitting element during the first subframe, a third sub-light-emission control signal for controlling emission of the third light emitting element during a second subframe, a fourth sub-light-emission control signal for controlling emission of the fourth light emitting element during the second subframe, and a first main light emission control signal, which is different from the first sub-light-emission control signal and the third sub-light-emission control signal, for controlling emission of the first and the third light emitting elements, wherein the first light emitting element is adjacent the second light emitting element, wherein the third light emitting element is adjacent the fourth light emitting element, wherein, during the first subframe, the first light emitting element and the second light emitting element are configured to emit light, and wherein, during the second subframe, the third light emitting element and the fourth light emitting element are configured to emit light.

2. The display device of claim 1, wherein a first data signal and a second data signal respectively corresponding to the first light emitting element and the second light emitting element are respectively delivered to the first pixel circuit and the second pixel circuit during the first subframe, and wherein a third data signal and a fourth data signal respectively corresponding to the third light emitting element and the fourth light emitting element are respectively delivered to the first pixel circuit and the second pixel circuit during the second subframe.

3. The display device of claim 2, wherein the first pixel circuit is coupled to a first scan line and a first initialization line, and the second pixel circuit is coupled to a second scan line and a second initialization line, wherein a driving current flowing through the first pixel circuit according to the first data signal is configured to be delivered to the first light emitting element according to the first sub-light-emission control signal, during the first subframe, and a driving current flowing through the second pixel circuit according to the second data signal is configured to be delivered to the second light emitting element according to the second sub-light-emission control signal, during the first subframe, and wherein the first pixel circuit is configured to receive the first data signal according to a first scan signal delivered through the first scan line, and the second pixel circuit is configured to receive the second data signal according to a second scan signal delivered through the second scan line, during the first subframe.

4. The display device of claim 2, wherein the first pixel circuit is coupled to a first scan line and a first initialization line, and the second pixel circuit is coupled to a second scan line and a second initialization line, wherein a driving current flowing through the first pixel circuit according to the third data signal is configured to be delivered to the third light emitting element according to the third sub-light-emission control signal, and a driving current flowing through the second pixel circuit according to the fourth data signal is configured to be delivered to the fourth light emitting element according to the fourth sub-light-emission control signal, during the second subframe, and wherein the first pixel circuit is configured to receive the third data signal according to a first scan signal delivered through the first scan line, and the second pixel circuit is configured to receive the fourth data signal according to a second scan signal delivered through the second scan line, during the second subframe.

5. The display device of claim 2, wherein the first pixel circuit comprises:

a first transistor configured to be turned on by a first scan signal to apply a corresponding data voltage to a second electrode of a second transistor;

the second transistor having a first electrode through which current is configured to flow corresponding to a voltage across a control electrode and the second electrode of the second transistor thereof, the second electrode being electrically coupled to a first power source;

a fifth transistor configured to be turned on by the first sub-light-emission control signal to deliver a current to the first light emitting element; and a sixth transistor configured to be turned on by the third sub-light-emission control signal to deliver a current to the third light emitting element, and wherein the second pixel circuit comprises:

a seventh transistor configured to be turned on by a second scan signal to apply a corresponding data voltage to a second electrode of an eighth transistor;

the eighth transistor having a first electrode through which current is configured to flow corresponding to a voltage across a control electrode and the second electrode of the eighth transistor thereof, the second electrode being electrically coupled to the first power source;

an eleventh transistor configured to be turned on by the second sub-light-emission control signal to deliver a current to the second light emitting element; and a twelfth transistor configured to be turned on by the fourth sub-light-emission control signal to deliver a current to the fourth light emitting element, wherein the fifth transistor and the eleventh transistor are turned on during the first subframe and the sixth transistor and the twelfth transistor are turned on during the second subframe.

6. The display device of claim 5, wherein the first pixel circuit further comprises a third transistor configured to be turned on in response to the first scan signal to diode-connect the second transistor, and wherein the second pixel circuit further comprises a ninth transistor configured to be turned on in response to the second scan signal to diode-connect the eighth transistor.

7. The display device of claim 6, wherein the first pixel circuit further comprises a fourth transistor configured to be turned on by a first initialization signal to apply an initialization voltage to the control electrode of the second transistor, wherein the second pixel circuit further comprises a tenth transistor configured to be turned on by a second initialization signal to apply an initialization voltage to the control electrode of the eighth transistor, wherein the first and third transistors are configured to be turned on by the first scan signal after the fourth transistor is turned on by the first initialization signal, and wherein the seventh and ninth transistors are configured to be turned on by the second scan signal after the tenth transistor is turned on by the second initialization signal.

8. The display device of claim 5, wherein the first pixel circuit further comprises a first capacitor coupled between the first power source and the control electrode of the second transistor, and wherein the second pixel circuit further comprises a second capacitor coupled between the first power source and the control electrode of the eighth transistor.

9. The display device of claim 6, wherein the first pixel circuit further comprises a third capacitor coupled between a control electrode of the first transistor and a second electrode of the third transistor, and wherein the second pixel circuit further comprises a fourth capacitor coupled between a control electrode of the seventh transistor and a second electrode of the ninth transistor.

10. The display device of claim 1, wherein the light emission driver is further configured to generate a second main light emission control signal different from the second sub-light-emission control signal and the fourth sub-light-emission control signal, for controlling emission of the second and the fourth light emitting elements.

11. A method of driving a display device comprising a display comprising a first pixel circuit, a second pixel circuit, and a pixel group comprising a first light emitting element, a second light emitting element that is adjacent the first light emitting element, a third light emitting element, and a fourth light emitting element that is adjacent the third light emitting element, that are sequentially arranged along a first direction, the first and third light emitting elements being coupled to the first pixel circuit and the second and fourth light emitting elements being coupled to the second pixel circuit, and a light emission driver configured to generate a first sub-light-emission control signal for controlling emission of the first light emitting element and a second sub-light-emission control signal for controlling emission of the second light emitting element during a first subframe, and configured to generate a third sub-light-emission control signal for controlling emission of the third light emitting element and a fourth sub-light-emission control signal for controlling emission of the fourth light emitting element during a second subframe, the method comprising:

delivering a first data signal and a second data signal respectively corresponding to the first light emitting element and the second light emitting element to the first pixel circuit and the second pixel circuit, respectively, during the first subframe;

delivering a driving current flowing through the first pixel circuit according to the first data signal to the first light emitting element according to the first sub-light-emission control signal and a first main light emission control signal different from the first sub-light-emission control signal, and delivering a driving current flowing through the second pixel circuit according to the second data signal to the second light emitting element according to the second sub-light-emission control signal during the first subframe;

emitting light from the first light emitting element and from the second light emitting element during the first subframe; and emitting light from the third light emitting element and the fourth light emitting element during the second subframe.

12. The method of claim 11, further comprising:

delivering a driving current flowing through the first pixel circuit according to a third data signal to the third light emitting element according to the third sub-light-emission control signal, and delivering a driving current flowing through the second pixel circuit according to a fourth data signal to the fourth light emitting element according to the fourth sub-light-emission control signal, during the second subframe; and delivering the third data signal to the first pixel circuit according to a first scan signal delivered through a first scan line, and delivering the fourth data signal to the second pixel circuit according to a second scan signal delivered through a second scan line, during the second subframe.

13. The method of claim 12, wherein the first pixel circuit comprises:

a first transistor configured to be turned on by a first scan signal to apply a corresponding data voltage to a second electrode of a second transistor;

the second transistor having a first electrode through which current is configured to flow corresponding to a voltage across a control electrode and the second electrode of the second transistor thereof, the second electrode being electrically coupled to a first power source;

a fifth transistor configured to be turned on by the first sub-light-emission control signal to deliver current to the first light emitting element; and a sixth transistor configured to be turned on by the third sub-light-emission control signal to deliver current to the third light emitting element, and wherein the second pixel circuit comprises:

a seventh transistor configured to be turned on by a second scan signal to apply a corresponding data voltage to a second electrode of an eighth transistor;

the eighth transistor having a first electrode through which current is configured to flow corresponding to a voltage across a control electrode and the second electrode of the eighth transistor thereof, the second electrode being electrically coupled to the first power source;

an eleventh transistor configured to be turned on by the second sub-light-emission control signal to deliver current to the second light emitting element; and a twelfth transistor configured to be turned on by the fourth sub-light-emission control signal to deliver current to the fourth light emitting element, wherein the method comprises:

turning on the fifth transistor and the eleventh transistor during the first subframe; and turning on the sixth transistor and the twelfth transistor during the second subframe.

14. The method of claim 13, wherein the first pixel circuit further comprises a third transistor configured to be turned on in response to the first scan signal to diode-connect the second transistor and a fourth transistor configured to be turned on by a first initialization signal to apply an initialization voltage to the control electrode of the second transistor, and wherein the second pixel circuit further comprises a ninth transistor configured to be turned on in response to the second scan signal to diode-connect the eighth transistor and a tenth transistor configured to be turned on by a second initialization signal to apply an initialization voltage to the control electrode of the eighth transistor, the method further comprising:

turning on the first and third transistors by the first scan signal after the fourth transistor is turned on by the first initialization signal; and turning on the seventh and ninth transistors by the second scan signal after the tenth transistor is turned on by the second initialization signal.

15. The method of claim 14, wherein the first pixel circuit further comprises a first capacitor coupled between the first power source and a control electrode of the second transistor, the method further comprising:

turning on the fourth transistor by the first initialization signal to apply an initialization voltage to the control electrode of the second transistor and maintaining a first voltage by the first capacitor.

16. The method of claim 14, wherein the second pixel circuit further comprises a second capacitor coupled between the first power source and a control electrode of the eighth transistor, the method further comprising:

turning on the tenth transistor by the second initialization signal to apply an initialization voltage to the control electrode of the eighth transistor and maintaining a second voltage by the second capacitor.

17. The method of claim 11, further comprising delivering the driving current flowing through the second pixel circuit according to the second data signal to the second light emitting element according to a second main light emission control signal different from the second sub-light-emission control signal during the first subframe.

* * * * *